US011359845B2

(12) United States Patent
D'Souza et al.

(10) Patent No.: US 11,359,845 B2
(45) Date of Patent: Jun. 14, 2022

(54) METHOD FOR DEFROSTING AN AIR CONDITIONER UNIT

(71) Applicant: Haier US Appliance Solutions, Inc., Wilmington, DE (US)

(72) Inventors: Bryan Isaac D'Souza, Louisville, KY (US); Richard Dustin Henderson, La Grange, KY (US)

(73) Assignee: Haler US Appliance Solutions, Inc., Wilmington, DE (US)

( * ) Notice: Subject to any disclaimer, the term of this patent is extended or adjusted under 35 U.S.C. 154(b) by 185 days.

(21) Appl. No.: 16/734,582

(22) Filed: Jan. 6, 2020

(65) Prior Publication Data

US 2021/0207858 A1 Jul. 8, 2021

(51) Int. Cl.

| | |
|---|---|
| ***F25D 21/00*** | (2006.01) |
| ***F25B 47/02*** | (2006.01) |
| ***F25B 39/00*** | (2006.01) |

(52) U.S. Cl.

CPC ..... *F25B 47/02* (2013.01); *F25B 39/00* (2013.01)

(58) Field of Classification Search

CPC .. F25B 47/02; F25B 39/00; F25B 2313/0315; F25B 2500/19; F25B 2700/02; F25B 2700/172; F25B 2700/173; F25B 47/022; F25B 2347/02; F25B 2700/11; F25B 2700/2116; F25B 2700/2117; F24F 11/42; F24F 11/64; F24F 11/65; F24F 11/41; F24F 11/43; F24F 11/62

See application file for complete search history.

(56) References Cited

U.S. PATENT DOCUMENTS

| | | | | |
|---|---|---|---|---|
| 5,257,506 | A | 11/1993 | DeWolf et al. | |
| 2012/0010754 | A1* | 1/2012 | Matteson | H05K 7/20836 700/282 |
| 2017/0176072 | A1* | 6/2017 | Gokhale | F25B 49/00 |
| 2017/0284717 | A1* | 10/2017 | Suzuki | F24F 1/0003 |
| 2020/0003443 | A1* | 1/2020 | Haynes | F24F 11/46 |
| 2021/0048200 | A1* | 2/2021 | Honjo | F24F 1/0059 |

FOREIGN PATENT DOCUMENTS

| | | |
|---|---|---|
| CN | 106288144 A | 1/2017 |
| CN | 105650821 B | 4/2019 |

* cited by examiner

*Primary Examiner* — Henry T Crenshaw
*Assistant Examiner* — Kamran Tavakoldavani
(74) *Attorney, Agent, or Firm* — Dority & Manning, P.A.

(57) ABSTRACT

A method of operating an air conditioner unit to implement effective defrost cycles includes obtaining a coil temperature of an outdoor heat exchanger, a dew point of a flow of air through the outdoor heat exchanger, and a flow rate of the flow of air. A frost rate of frost buildup on the outdoor heat exchanger is estimated based on the coil temperature, the dew point, and the flow rate, and a frost quantity or weight is determined by integrating the frost rate. A defrost cycle is initiated if the frost quantity exceeds a predetermined frost threshold, e.g., in pounds of water.

20 Claims, 4 Drawing Sheets

METHOD FOR DEFROSTING AN AIR CONDITIONER UNIT

FIELD OF THE INVENTION

The present disclosure relates generally to air conditioner units, and more particularly to methods for effectively defrosting the outdoor heat exchange coils of air conditioner units.

BACKGROUND OF THE INVENTION

Air conditioner or conditioning units are conventionally utilized to adjust the temperature indoors—i.e. within structures such as dwellings and office buildings. Such units commonly include a closed refrigeration loop to heat or cool the indoor air. Typically, the indoor air is recirculated while being heated or cooled. A variety of sizes and configurations are available for such air conditioner units. For example, some units may have one portion installed within the indoors that is connected, by e.g., tubing carrying the refrigerant, to another portion located outdoors. These types of units are typically used for conditioning the air in larger spaces. Another type of air conditioner unit, referred to as a packaged terminal air conditioner unit, operate like split heat pump systems, except that the indoor and outdoor portions are defined by a bulkhead and all system components are housed within a single package.

Heat pump systems tend to accumulate frost on the outdoor coil when operated in near- or sub-freezing conditions. This frost needs to be cleared periodically to maintain proper, efficient operation of the air conditioner unit. However, conventional air conditioner units do not have effective means for determining the amount of frost on the outdoor heat exchanger, and thus have no way to determine the optimal time to initiate a defrost cycle. Certain air conditioner units may include defrost systems for monitoring frost or detecting excessive frost buildup, but such systems are typically complex, costly, and have limited effectiveness at accurately estimating the amount of frost on the outdoor heat exchanger.

Accordingly, improved air conditioner units and features for detecting frost buildup would be useful. More specifically, air conditioner units and methods of operation for detecting the quantity of frost build up in a cost-effective matter would be particularly beneficial.

BRIEF DESCRIPTION OF THE INVENTION

Aspects and advantages of the invention will be set forth in part in the following description, or may be apparent from the description, or may be learned through practice of the invention.

In accordance with one exemplary embodiment of the present disclosure, an air conditioner unit is provided, including an outdoor heat exchanger, an outdoor fan for urging a flow of air through the outdoor heat exchanger, and a controller communicatively coupled with the outdoor fan. The controller is configured for obtaining a coil temperature of the outdoor heat exchanger, obtaining a dew point of the flow of air, obtaining a flow rate of the flow of air through the outdoor heat exchanger, estimating a frost rate on the outdoor heat exchanger based at least in part on the coil temperature, the dew point, and the flow rate, determining a frost quantity by integrating the frost rate, and initiating a defrost cycle if the frost quantity exceeds a predetermined frost threshold.

In accordance with another exemplary embodiment of the present disclosure, a method of operating an air conditioner unit is provided. The air conditioner unit includes an outdoor fan for urging a flow of air through an outdoor heat exchanger. The method includes obtaining a coil temperature of the outdoor heat exchanger, obtaining a dew point of the flow of air, obtaining a flow rate of the flow of air through the outdoor heat exchanger, estimating a frost rate on the outdoor heat exchanger based at least in part on the coil temperature, the dew point, and the flow rate, determining a frost quantity by integrating the frost rate, and initiating a defrost cycle if the frost quantity exceeds a predetermined frost threshold.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
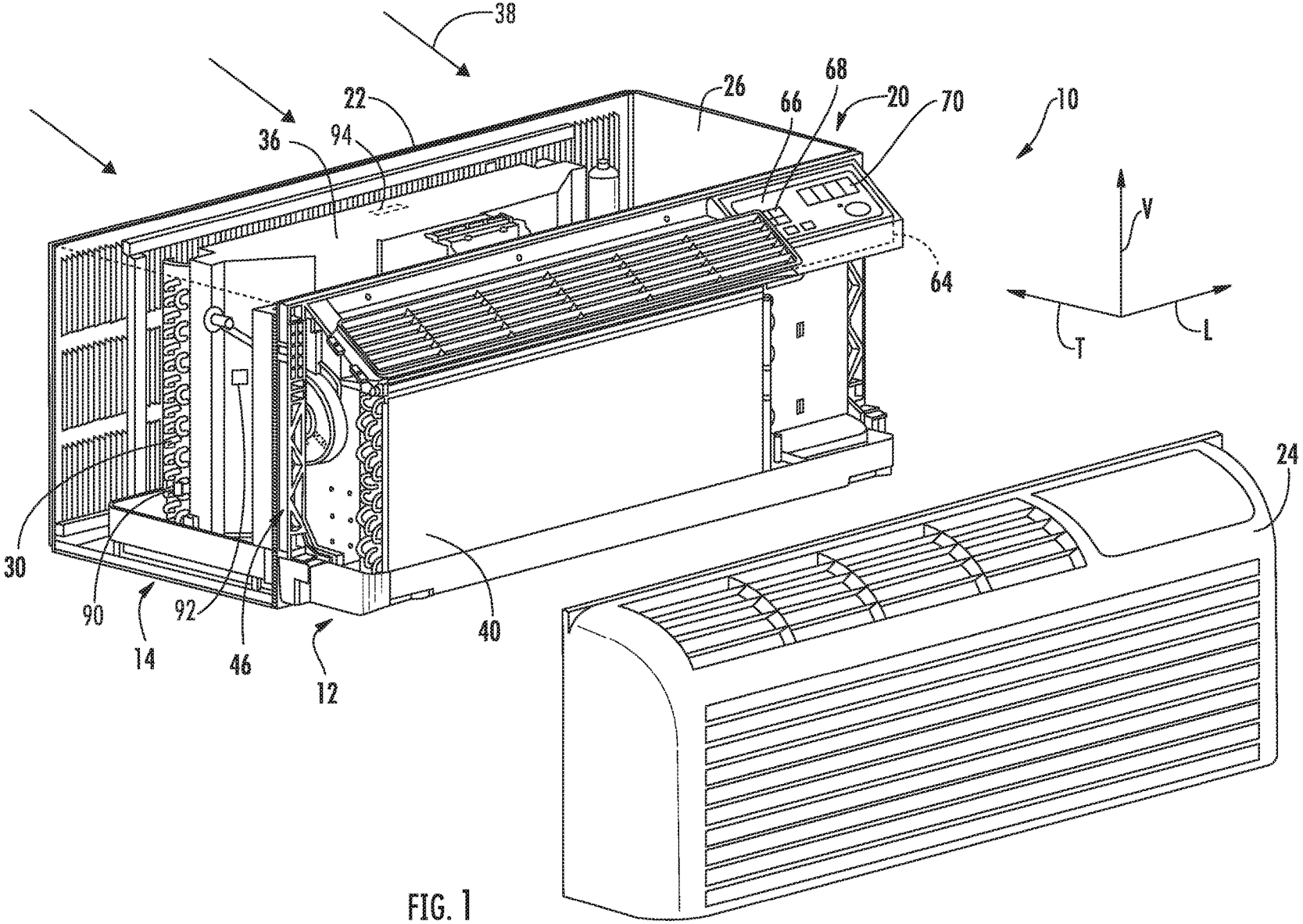
FIG. 1 provides a perspective view of an air conditioner unit, with part of an indoor portion exploded from a remainder of the air conditioner unit for illustrative purposes, in accordance with one exemplary embodiment of the present disclosure.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows and "downstream" refers to the direction to which the fluid flows. In addition, terms of approximation, such as "approximately," "substantially," or "about," refer to being within a ten percent margin of error.

Referring now to FIG. 1, an air conditioner unit 10 is provided. The air conditioner unit 10 is a one-unit type air conditioner, also conventionally referred to as a room air conditioner or a packaged terminal air conditioner (PTAC). The unit 10 includes an indoor portion 12 and an outdoor portion 14, and generally defines a vertical direction V, a lateral direction L, and a transverse direction T. Each direction V, L, T is perpendicular to each other, such that an orthogonal coordinate system is generally defined.

A housing 20 of the unit 10 may contain various other components of the unit 10. Housing 20 may include, for example, a rear grill 22 and a room front 24 which may be spaced apart along the transverse direction T by a wall sleeve 26. The rear grill 22 may be part of the outdoor portion 14, and the room front 24 may be part of the indoor portion 12. Components of the outdoor portion 14, such as an outdoor heat exchanger 30, an outdoor fan 32 (FIG. 2), and a compressor 34 (FIG. 2) may be housed within the wall sleeve 26. A casing 36 may additionally enclose outdoor fan 32, as shown, such that a flow of outdoor air 38 is drawn in through rear grill 22 and passes around casing 36 before being urged by outdoor fan 32 through outdoor heat exchanger 30 and back into the ambient environment.

Figure 2:
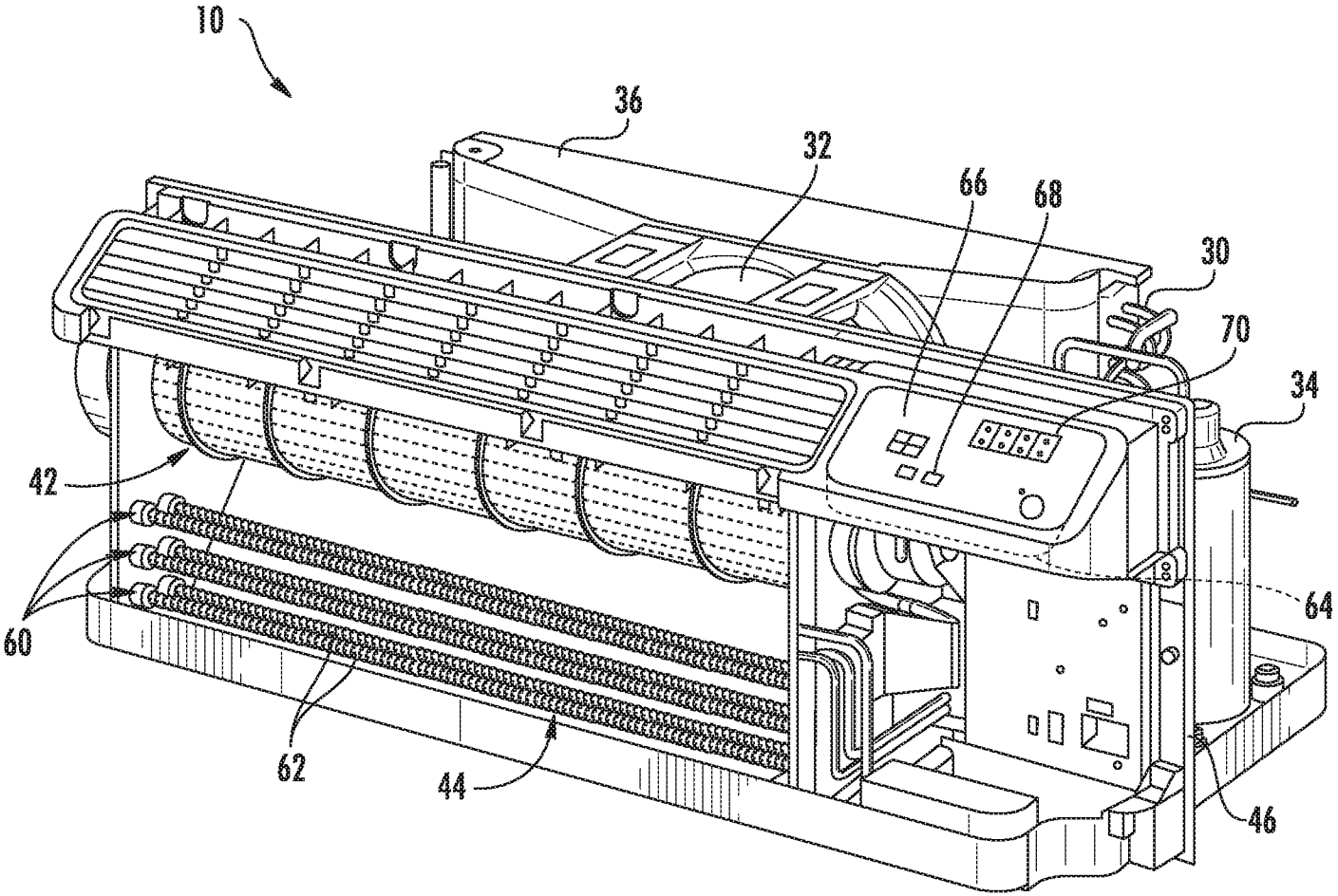
FIG. 2 is another perspective view of components of the indoor portion of the exemplary air conditioner unit of FIG. 1.

Referring now also to FIG. 2, indoor portion 12 may include, for example, an indoor heat exchanger 40 (FIG. 1), a blower fan 42, and a heating unit 44. These components may, for example, be housed behind the room front 24. Additionally, a bulkhead 46 may generally support and/or house various other components or portions thereof of the indoor portion 12, such as the blower fan 42 and the heating unit 44. Bulkhead 46 may generally separate and define the indoor portion 12 and outdoor portion 14.

Figure 3:
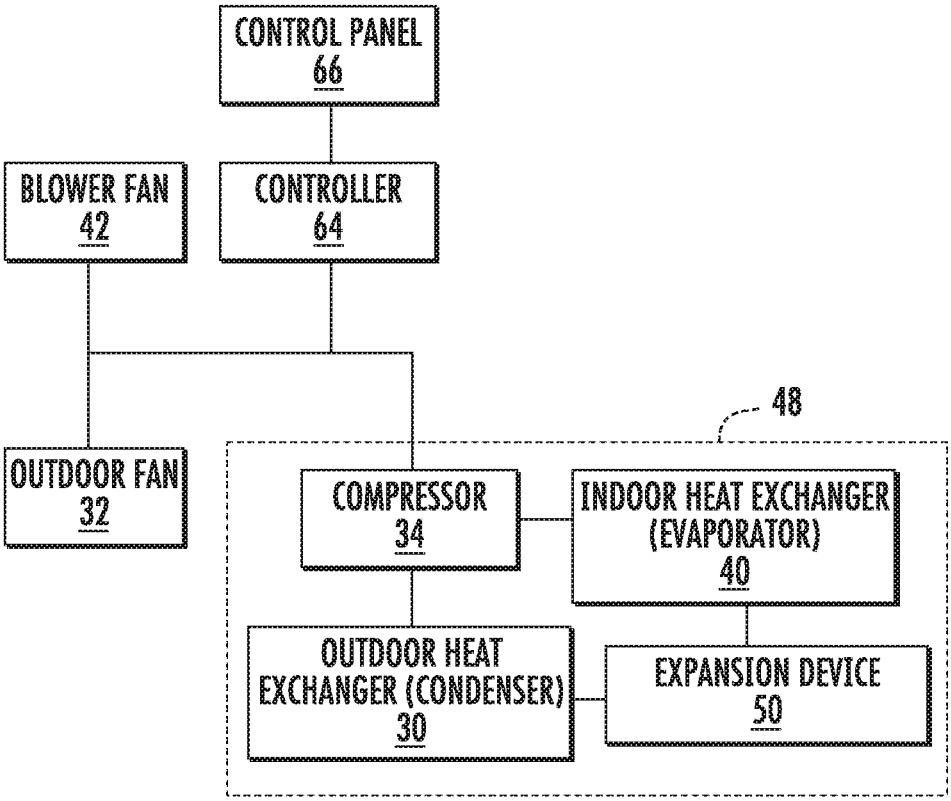
FIG. 3 is a schematic view of a refrigeration loop in accordance with one embodiment of the present disclosure.

Outdoor and indoor heat exchangers 30, 40 may be components of a refrigeration loop 48, which is shown schematically in FIG. 3. Refrigeration loop 48 may, for example, further include compressor 34 and an expansion device 50. As illustrated, compressor 34 and expansion device 50 may be in fluid communication with outdoor heat exchanger 30 and indoor heat exchanger 40 to flow refrigerant therethrough as is generally understood. More particularly, refrigeration loop 48 may include various lines for flowing refrigerant between the various components of refrigeration loop 48, thus providing the fluid communication there between. Refrigerant may thus flow through such lines from indoor heat exchanger 40 to compressor 34, from compressor 34 to outdoor heat exchanger 30, from outdoor heat exchanger 30 to expansion device 50, and from expansion device 50 to indoor heat exchanger 40. The refrigerant may generally undergo phase changes associated with a refrigeration cycle as it flows to and through these various components, as is generally understood. Suitable refrigerants for use in refrigeration loop 48 may include pentafluoroethane, difluoromethane, or a mixture such as R410a, although it should be understood that the present disclosure is not limited to such example and rather that any suitable refrigerant may be utilized.

As is understood in the art, refrigeration loop 48 may be alternately be operated as a refrigeration assembly (and thus perform a refrigeration cycle) or a heat pump (and thus perform a heat pump cycle). As shown in FIG. 3, when refrigeration loop 48 is operating in a cooling mode and thus performs a refrigeration cycle, the indoor heat exchanger 40 acts as an evaporator and the outdoor heat exchanger 30 acts as a condenser. Alternatively, when the assembly is operating in a heating mode and thus performs a heat pump cycle, the indoor heat exchanger 40 acts as a condenser and the outdoor heat exchanger 30 acts as an evaporator. The outdoor and indoor heat exchangers 30, 40 may each include coils through which a refrigerant may flow for heat exchange purposes, as is generally understood.

According to an example embodiment of the present subject matter, compressor 34 is a single speed compressor configured for operating at a desirable rated operating speed. However, it should be appreciated that according to alternative embodiments, compressor 34 may be a variable speed compressor. In this regard, compressor 34 may be operated at various speeds depending on the current air conditioning needs of the room and the demand from refrigeration loop 48. For example, according to an exemplary embodiment, compressor 34 may be configured to operate at any speed between a minimum speed, e.g., 1500 revolutions per minute (RPM), to a maximum rated speed, e.g., 3500 RPM. Notably, use of variable speed compressor 34 enables efficient operation of refrigeration loop 48 (and thus air conditioner unit 10), minimizes unnecessary noise when compressor 34 does not need to operate at full speed, and ensures a comfortable environment within the room.

In exemplary embodiments as illustrated, expansion device 50 may be disposed in the outdoor portion 14 between the indoor heat exchanger 40 and the outdoor heat exchanger 30. According to the exemplary embodiment, expansion device 50 may be a capillary tube or another suitable expansion device configured for use in a thermodynamic cycle. However, according to alternative embodiments, expansion device may be an electronic expansion valve that enables controlled expansion of refrigerant, as is known in the art. In this regard, electronic expansion device 50 may be configured to precisely control the expansion of the refrigerant to maintain, for example, a desired temperature differential of the refrigerant across the indoor heat exchanger 40. In other words, electronic expansion device 50 throttles the flow of refrigerant based on the reaction of the temperature differential across indoor heat exchanger 40 or the amount of superheat temperature differential, thereby ensuring that the refrigerant is in the gaseous state entering compressor 34.

According to the illustrated exemplary embodiment, outdoor fan 32 is an axial fan and indoor blower fan 42 is a centrifugal fan. However, it should be appreciated that according to alternative embodiments, outdoor fan 32 and blower fan 42 may be any suitable fan type. In addition, according to an exemplary embodiment, outdoor fan 32 and blower fan 42 are variable speed fans. For example, outdoor fan 32 and blower fan 42 may rotate at different rotational speeds, thereby generating different air flow rates. It may be desirable to operate fans 32, 42 at less than their maximum rated speed to ensure safe and proper operation of refrigeration loop 48 at less than its maximum rated speed, e.g., to reduce noise when full speed operation is not needed.

According to the illustrated embodiment, blower fan 42 may operate as an evaporator fan in refrigeration loop 48 to encourage the flow of air through indoor heat exchanger 40. Accordingly, blower fan 42 may be positioned downstream of indoor heat exchanger 40 along the flow direction of indoor air and downstream of heating unit 44. Alternatively, blower fan 42 may be positioned upstream of indoor heat exchanger 40 along the flow direction of indoor air and may operate to push air through indoor heat exchanger 40.

Heating unit 44 in exemplary embodiments includes one or more heater banks 60. Each heater bank 60 may be operated as desired to produce heat. In some embodiments as shown, three heater banks 60 may be utilized. Alternatively, however, any suitable number of heater banks 60 may be utilized. Each heater bank 60 may further include at least one heater coil or coil pass 62, such as in exemplary embodiments two heater coils or coil passes 62. Alternatively, other suitable heating elements may be utilized.

The operation of air conditioner unit 10 including compressor 34 (and thus refrigeration loop 48 generally) blower fan 42, outdoor fan 32, heating unit 44, expansion device 50, and other components of refrigeration loop 48 may be controlled by a processing device such as a controller 64. Controller 64 may be in communication (via for example a suitable wired or wireless connection) to such components of the air conditioner unit 10. Controller 64 may include a memory and one or more processing devices such as microprocessors, CPUs or the like, such as general or special purpose microprocessors operable to execute programming instructions or micro-control code associated with operation of unit 10. The memory may represent random access memory such as DRAM, or read only memory such as ROM or FLASH. In one embodiment, the processor executes programming instructions stored in memory. The memory may be a separate component from the processor or may be included onboard within the processor.

Unit 10 may additionally include a control panel 66 and one or more user inputs 68, which may be included in control panel 66. The user inputs 68 may be in communication with the controller 64. A user of the unit 10 may interact with the user inputs 68 to operate the unit 10, and user commands may be transmitted between the user inputs 68 and controller 64 to facilitate operation of the unit 10 based on such user commands. A display 70 may additionally be provided in the control panel 66, and may be in communication with the controller 64. Display 70 may, for example be a touchscreen or other text-readable display screen, or alternatively may simply be a light that can be activated and deactivated as required to provide an indication of, for example, an event or setting for the unit 10.

Now that the construction of air conditioner unit 10 has been described according to exemplary embodiments, an exemplary method 200 of operating an outdoor fan of a packaged terminal air conditioner unit to detect frost build up and initiate defrost cycles will be described. Although the discussion below refers to the exemplary method 200 of operating air conditioner unit 10, one skilled in the art will appreciate that the exemplary method 200 is applicable to the operation of a variety of other air conditioner units or fan assemblies. According to exemplary embodiments, controller 64 or another suitable dedicated controller may be configured for performing method 200.

Figure 4:
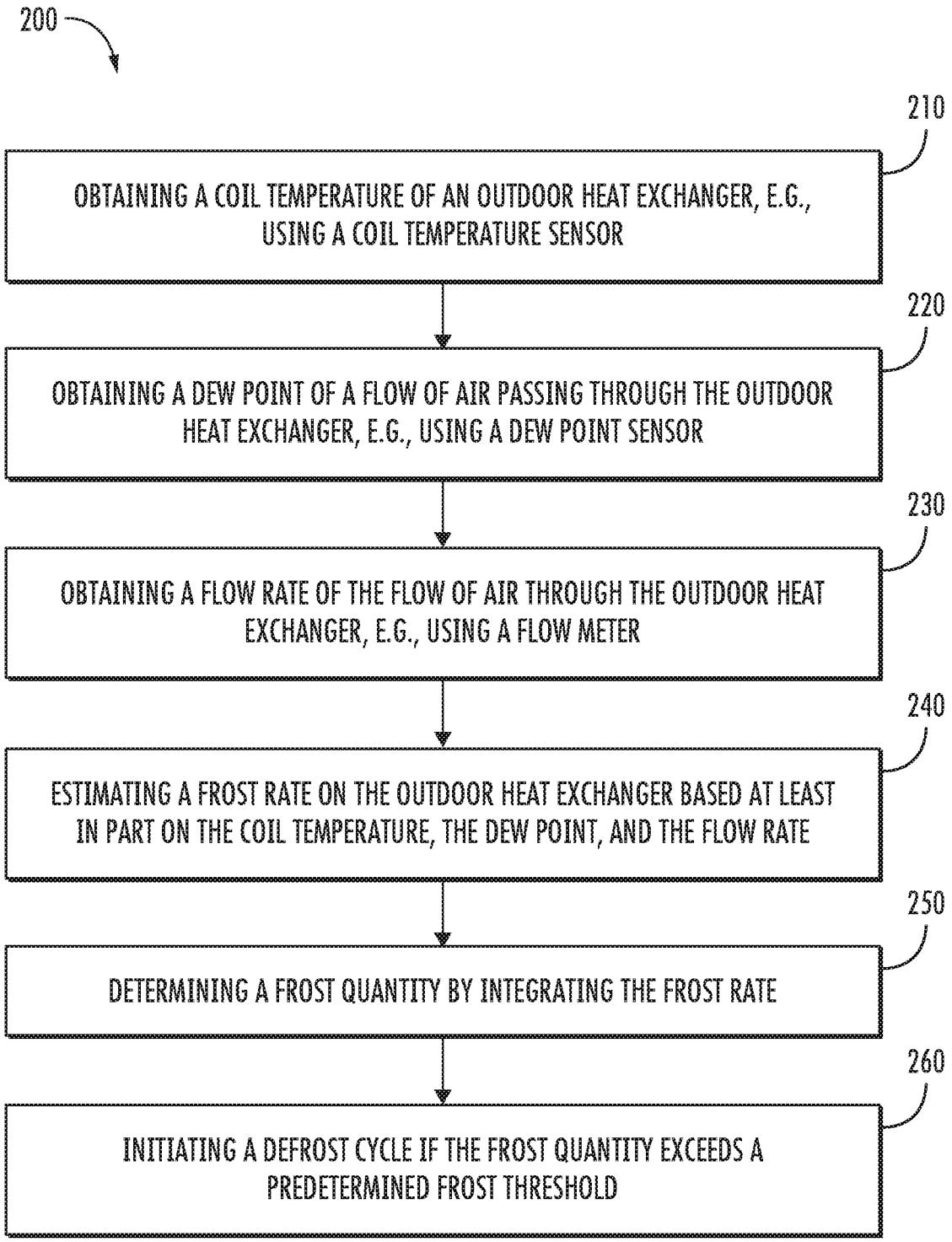
FIG. 4 is a method of operating an air conditioner unit for effective detection and initiation of defrost cycles according to an exemplary embodiment of the present subject matter.

Referring now to FIG. 4, method 200 includes, at step 210, obtaining a coil temperature of an outdoor heat exchanger. For example, continuing the example from above, the coil temperature may be measured by a contact probe or a coil temperature sensor (e.g., as indicated by reference numeral 90 in FIG. 1) mounted to the coils of outdoor heat exchanger 30. According to alternative embodiments, the outdoor coil temperature may be determined in any other suitable manner, such as based on empirical data, operating conditions, indoor coil temperature, etc.

Step 220 includes obtaining a dewpoint of a flow of air passing through the outdoor heat exchanger. For example, air conditioner unit 10 may include a dew point sensor (e.g., as indicated by reference numeral 92 in FIG. 1) positioned within outdoor portion 14 for detecting the dew point of the flow of air 38. It should be appreciated that other means for determining the dew point may be used while remaining within the scope of the present subject matter. For example, according to another exemplary embodiment, the dew point may be estimated based on an outdoor ambient temperature. In this regard, for example, a correction factor may be applied to the outdoor ambient temperature to provide an estimate of the dew point. In this regard, for example, the correction factor may be based on empirical data and may be a function of or an estimate of a relative humidity of the flow of air 38.

Step 230 includes obtaining a flow rate of the flow of air through the outdoor heat exchanger. In this regard, for example, air conditioner unit 10 may include a flow meter (e.g., as indicated by reference numeral 94 in FIG. 1) that is used for detecting the flow rate of the flow of air 38. According to alternative embodiments, flow meter 94 may be removed and the flow rate of the flow of air 38 may be estimated in any other suitable manner, such as based on the speed of the outdoor fan 32. In this regard, for example, controller 64 may contain a lookup table that contains various fan set points and associated flow rates. Controller 64 may obtain the set point of outdoor fan 32 and may use lookup table to determine the associated flow rate.

Notably, the coil temperature of the outdoor heat exchanger, the dew point of the flow of outdoor air, and the flow rate of the outdoor air have a very high impact on the rate of frost build up on the outdoor heat exchanger 30. Thus, aspects of the present subject matter are directed to using such parameters in order to estimate the rate of frost build up (e.g., in pounds of water per second) and the precise amount of frost on the outdoor heat exchanger 30 (e.g., in pounds of water). Although exemplary rules and algorithms for estimating the frost rate based on these parameters are provided below, it should be appreciated that these rules and algorithms may vary while remaining within the scope of the present subject matter.

Specifically, according to an exemplary embodiment, step 240 includes estimating a frost rate on the outdoor heat exchanger based at least in part on the coil temperature, the dew point, and the flow rate. As explained above, the frost rate may be estimated using a variety of rules, empirical data, physics-based estimates, and other operating conditions. For example, estimating the frost rate may include setting the frost rate to zero (pound of water per second) if the coil temperature is greater than the dew point or a freezing temperature of water (e.g., 32° F.). Notably, if either of these two conditions exist, it is not likely that water vapor would condense and freeze on the outdoor heat exchanger 30.

According to an exemplary embodiment, if the coil temperature is below the dew point and the coil temperature is below a freezing point of water (e.g., 32° F.), the frost rate may be set equal to the product of (1) the flow rate of flow of air 38 and (2) a difference in a humidity ratio between the dew point and an outdoor coil saturation temperature.

Notably, the effectiveness and efficiency of air conditioning unit 10 is often inversely correlated to the quantity or amount of frost on the outdoor heat exchanger 30, e.g., in pounds of water. Thus, according to exemplary embodiments, it is desirable to use the frost rate to determine precisely the weight of frost on the coils. Thus, step 250 includes determining a frost quantity by integrating the frost rate. In this regard, the frost rate is constantly monitored at step 240, and this frost rate may be integrated to obtain a running estimate of the amount of frost on the outdoor heat exchanger 30. Step 260 includes initiating a defrost cycle if the frost quantity exceeds a predetermined frost threshold. Notably, the frost threshold may be a weight of frost, e.g., in pounds of water, that is set by the manufacturer, set using empirical data, set by the user, or determined in any other suitable manner. For example, the frost threshold may be between about 0.1 and 2.0 pounds of water, between about 0.2 and 1.5 pounds of water, between about 0.3 and 1.0 pounds of water, between about 0.4 and 0.8 pounds of water, or about 0.5 pounds of water.

Notably, the defrost cycle may include any suitable sequence of operations of air conditioner unit 10 intended to remove or dislodge frost from outdoor heat exchanger 30. For example, the defrost cycle may include reversing the operation of refrigeration loop 48, e.g., to provide a flow of hot refrigerant through outdoor heat exchanger 30. In addition, because the defrost cycle typically lowers the temperature of the indoor heat exchanger 40, the defrost cycle may further include the energizing heater bank 60, e.g., to maintain the room temperature at a comfortable level. Alternatively, air-conditioning unit 10 may include defrost heaters mounted onto or adjacent outdoor heat exchanger 30, may include bypass valves for diverting hot refrigerant to outdoor heat exchanger 30, or may include any other sealed system configuration for performing the defrost cycle. According to exemplary embodiments, method 200 may further include resetting the frost quantity to zero after the defrost cycle has been completed. In this manner, method 200 may be repeated after the coil is cleared to determine an accurate amount of frost on outdoor heat exchanger 30.

FIG. 4 depicts steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 200 are explained using air conditioner unit 10 as an example, it should be appreciated that these methods may be applied to the operation of any air conditioner unit having any other suitable configuration.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An air conditioner unit, comprising:
an outdoor heat exchanger;
an outdoor fan for urging a flow of air through the outdoor heat exchanger; and
a controller communicatively coupled with the outdoor fan, the controller configured for:
obtaining a coil temperature of the outdoor heat exchanger;
obtaining a dew point of the flow of air;
obtaining a flow rate of the flow of air through the outdoor heat exchanger;
estimating a frost rate on the outdoor heat exchanger based at least in part on the coil temperature, the dew point, and the flow rate, wherein the frost rate is equal to a product of 1) the flow rate of the flow of air and 2) a difference between a first humidity ratio at the dew point and a second humidity ratio at an outdoor coil saturation temperature;
determining a frost quantity by integrating the frost rate; and
initiating a defrost cycle if the frost quantity exceeds a predetermined frost threshold.

2. The air conditioner unit of claim 1, wherein estimating the frost rate comprises:
setting the frost rate to zero if the coil temperature is greater than the dew point or a freezing temperature of water.

3. The air conditioner unit of claim 1, wherein obtaining the dew point comprises:
obtaining an outdoor ambient temperature; and
determining the dew point by applying a correction factor to the outdoor ambient temperature.

4. The air conditioner unit of claim 3, wherein the correction factor is based on an estimate of a relative humidity of the flow of air.

5. The air conditioner unit of claim 1, wherein obtaining the flow rate comprises:
obtaining a set point of the outdoor fan; and
obtaining the flow rate using a lookup table based on the set point.

6. The air conditioner unit of claim 1, further comprising:
resetting the frost quantity to zero after the defrost cycle has been completed.

7. The air conditioner unit of claim 1, wherein initiating the defrost cycle comprises:
energizing a heating unit; and
providing a flow of hot refrigerant through the outdoor heat exchanger.

8. The air conditioner unit of claim 1, wherein the air conditioner unit comprises:
a flow meter for determining the flow rate of the flow of air through the outdoor heat exchanger.

9. The air conditioner unit of claim 1, wherein the air conditioner unit comprises:
a coil temperature sensor for measuring the coil temperature of the outdoor heat exchanger.

10. The air conditioner unit of claim 1, wherein the air conditioner unit comprises:
a dew point sensor for determining the dew point of the flow of air.

11. The air conditioner unit of claim 1, wherein the flow rate of the flow of air is measured in pounds of dry air per second and both the first humidity ratio and the second humidity ratio are measured in pounds of water per pounds of dry air.

12. A method of operating an air conditioner unit, the air conditioner unit comprising an outdoor fan for urging a flow of air through an outdoor heat exchanger, the method comprising:
obtaining a coil temperature of the outdoor heat exchanger;
obtaining a dew point of the flow of air;
obtaining a flow rate of the flow of air through the outdoor heat exchanger;
estimating a frost rate on the outdoor heat exchanger based at least in part on the coil temperature, the dew point, and the flow rate, wherein the frost rate is equal to a product of 1) the flow rate of the flow of air and 2) a difference between a first humidity ratio at the dew point and a second humidity ratio at an outdoor coil saturation temperature;

determining a frost quantity by integrating the frost rate; and initiating a defrost cycle if the frost quantity exceeds a predetermined frost threshold.

13. The method of claim 12, wherein estimating the frost rate comprises:

setting the frost rate to zero if the coil temperature is greater than the dew point or a freezing temperature of water.

14. The method of claim 12, wherein obtaining the dew point comprises:

obtaining an outdoor ambient temperature; and determining the dew point by applying a correction factor to the outdoor ambient temperature.

15. The method of claim 14, wherein the correction factor is based on an estimate of a relative humidity of the flow of air.

16. The method of claim 12, wherein obtaining the flow rate comprises:

obtaining a set point of the outdoor fan; and obtaining the flow rate using a lookup table based on the set point.

17. The method of claim 12, further comprising:

resetting the frost quantity to zero after the defrost cycle has been completed.

18. The method of claim 12, wherein initiating the defrost cycle comprises:

energizing a heating unit; and providing a flow of hot refrigerant through the outdoor heat exchanger.

19. The method of claim 12, wherein the flow rate is measured using a flow meter, the coil temperature is measured by a coil temperature sensor, or the dew point is measured by a dew point sensor.

20. The method of claim 12, wherein the flow rate of the flow of air is measured in pounds of dry air per second and both the first humidity ratio and the second humidity ratio are measured in pounds of water per pounds of dry air.

* * * * *